United States Patent [19]

Shiau Ruey J.

[11] Patent Number: 4,934,697

[45] Date of Patent: Jun. 19, 1990

[54] AUTOMATIC GOLF PRACTICING COURSE

[76] Inventor: Shiau Ruey J., No. 10, Lane 48, Sec. 2, Chung Shan N. Rd., Taipei, Taiwan

[21] Appl. No.: 427,498

[22] Filed: Oct. 27, 1989

[51] Int. Cl.[5] ..... A63B 69/36

[52] U.S. Cl. ..... 273/35 B; 273/201; 273/176 K; 273/182 R; 273/179 D; 273/181 J; 273/176 FA; 273/176 H

[58] Field of Search ..... 273/176 R, 176 K, 178 R, 273/35 R, 35 B, 183 R, 183 A, 182 R, 195 R, 178 A, 179 R, 179 A, 179 B, 179 C, 179 D, 201, 181 R, 176 F, 176 FA, 176 H

[56] References Cited

U.S. PATENT DOCUMENTS

| | | | |
|---|---|---|---|
| 1,931,841 | 10/1933 | Evans | 273/179 D X |
| 2,110,925 | 3/1938 | Trangmar | 273/179 C |
| 2,295,599 | 9/1942 | Mozel | 273/183 A X |
| 2,520,952 | 9/1950 | Mozel | 273/183 A |
| 2,609,199 | 9/1952 | Koener | 273/179 B |
| 3,567,223 | 1/1967 | Gentiluomo | 273/201 X |
| 3,778,067 | 12/1973 | Gentiluomo | 273/201 |
| 4,018,436 | 4/1977 | Leigh | 273/179 C X |
| 4,198,054 | 4/1980 | Stone | 273/182 R X |
| 4,272,078 | 6/1981 | Vinette | 273/179 D X |
| 4,832,345 | 5/1989 | Monasco | 273/201 |

*Primary Examiner*—Edward M. Cohn
*Assistant Examiner*—Sebastiano Passaniti
*Attorney, Agent, or Firm*—Morton J. Rosenberg; David I. Klein

[57] ABSTRACT

An automatic golf practicing course having a number of fairways, including a number of rows of subposts and a number of uniform flat plates. The subposts are spaced within the fairways, each row of subposts is connected with a turning bar. The flat plates are covered with rubber and artificial grass to form the fairways. The plates are pivotably mounted on turning bars and supported by the subposts. The plates covers an overall area of the fairways. A number of pairs of controlling bars are engaged to both ends of the turning bars at their upper ends. A pair of tappets are horizontally disposed at both sides of the fairways and attached to a lower end of each controlling bar and engaged thereat. An inclined plate is provided below the tappets and inclined toward a tee off area. The inclined plate extending an overall area of the fairways and supported by distantly disposed base with its top surface having a same slope as the inclined plate. A number of conveyers and lifters are provided adjacent to a lower end of the inclined plate for conveying the golf balls. An air compressor and a centrally disposed cylinder having a piston and a pushing means are used to incorporate with the turning bar to pivot the flat plates and let the golf balls thereon fall down onto the inclined plate and be conveyed by the conveyers and lifters.

10 Claims, 9 Drawing Sheets

AUTOMATIC GOLF PRACTICING COURSE

BACKGROUND OF THE INVENTION

The present invention relates to an automatic golf practicing course.

The popularity of golf has increased rapidly in recent years, therefore, the demands on the golf practicing courses are more than ever. However, no matter what the equipment involved or how much the expense of a conventional practicing course, the major problem existing therein is the collection of the golf balls. After a certain period of time, workers with or without a cart must be sent to pick up the golf balls on the practicing course. It takes a great deal of money to employ the workers. Furthermore, it inhibits the practicing of the practicer while the workers are picking up the balls.

Therefore, a most urgent need in this field is to provide an automatic practicing course for eliminating the above-mentioned problems and disadvantages.

SUMMARY OF THE INVENTION

It is an object of the present invention to provide an automatic practicing course for collecting golf balls automatically without the employment of workers.

It is another object of the present invention to provide a plurality of fairways comprised of a plurality of pivotable plates covered with rubber and artificial grass for teeing practicing thereon which permit the golf balls to fall down therefrom while the plates are turned to incline toward the practicers.

It is still another object of the present invention to provide conveyers and lifters for continuously supplying golf balls for golf practicers.

It is yet another object of the present invention to provide electric eyes adjacent to the tees for sensing whether a ball is on the tees or not, so as to supply balls continuously by the provision of lifters.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENT

Figure 1:
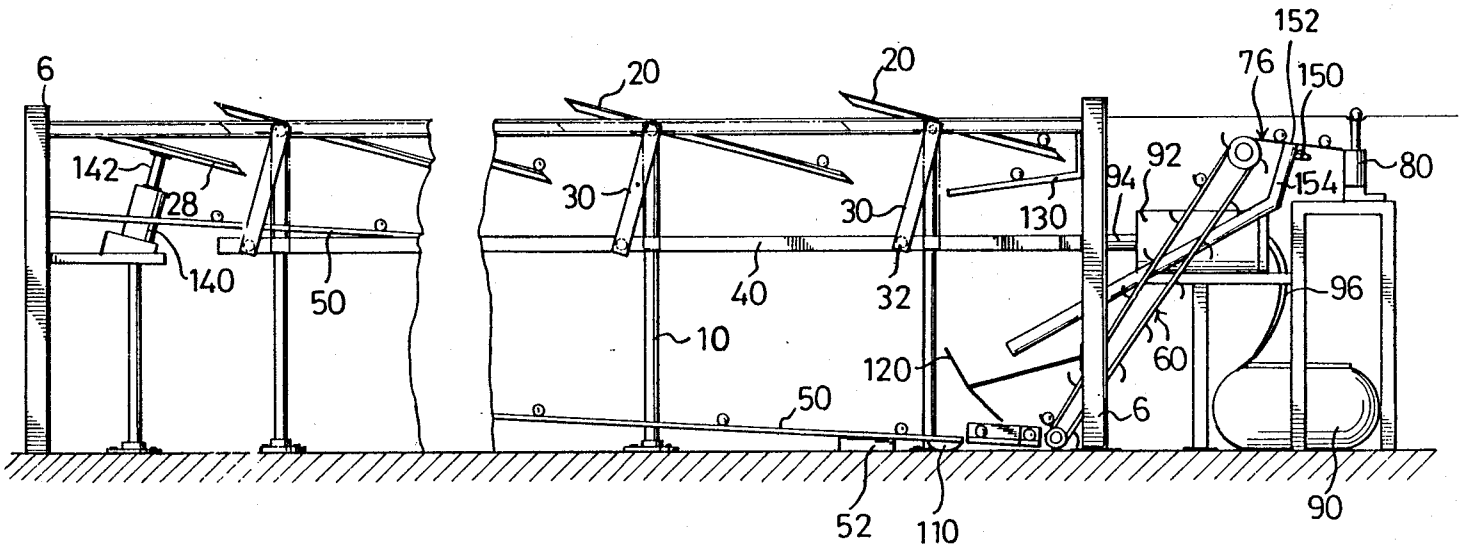
FIG. 1 is a schematic view of an automatic golf practicing course in accordance with the present invention.
Figure 2:
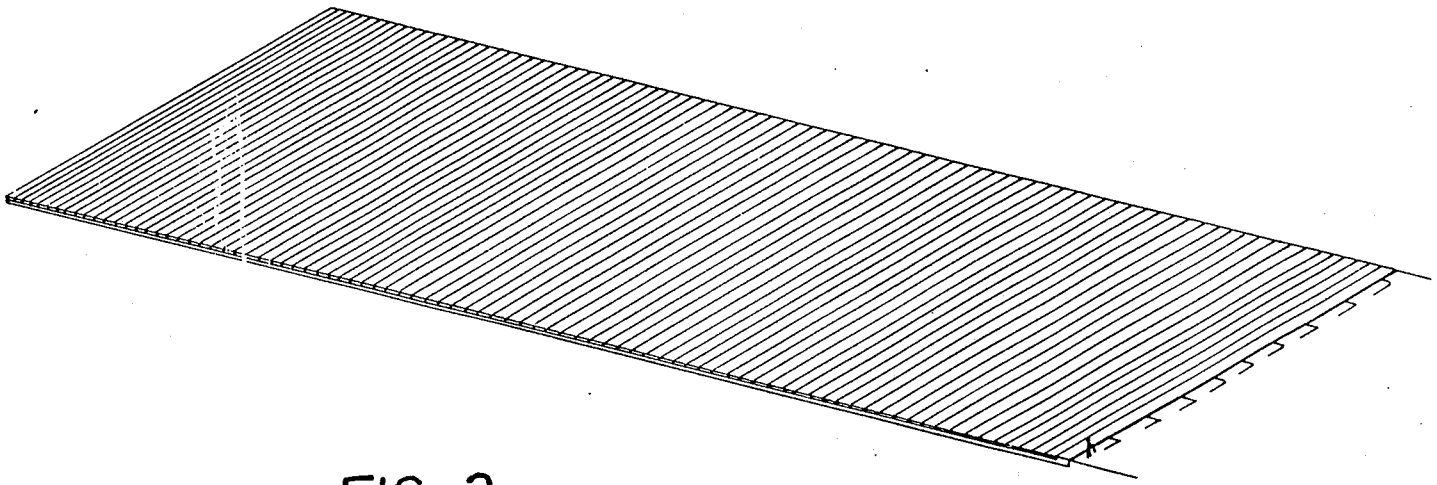
FIG. 2 is a perspective overview of the automatic golf practicing course in accordance with the present invention.

Referring to FIGS. 1 and 2, it can be seen that an automatic golf practicing course according to the present invention includes a plurality of fairways formed by a plurality of flat plates 20 and four main posts 6 disposed on four corners. Four connecting bars 8 are provided between the main posts 6 for connecting each of the adjacent main posts 6 at their upper ends to form a rectangular fairway area.

Figure 3:
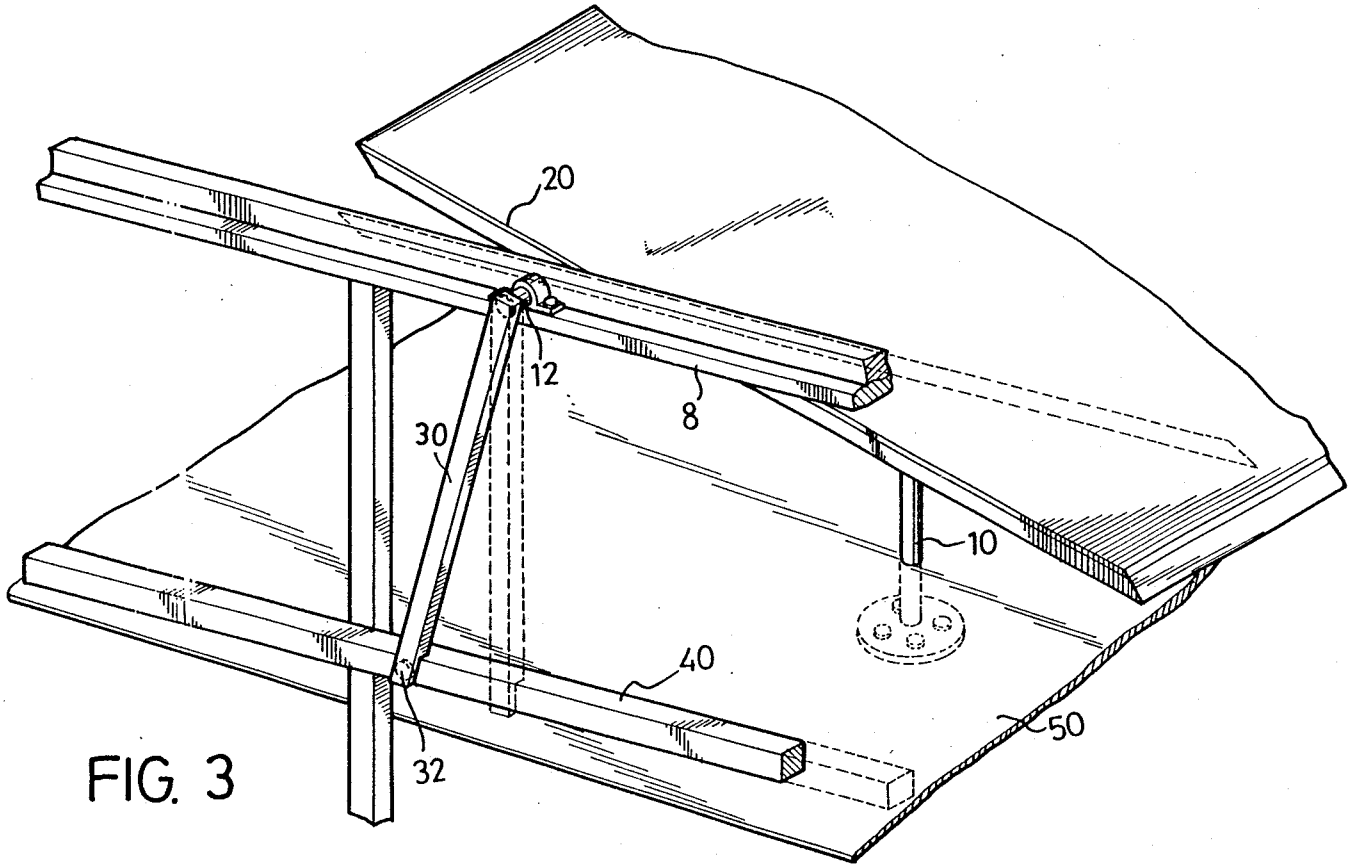
FIG. 3 is a cutaway perspective view of the automatic golf practicing course showing the relative movement between a plate, a controlling bar and a tappet.
Figure 4:
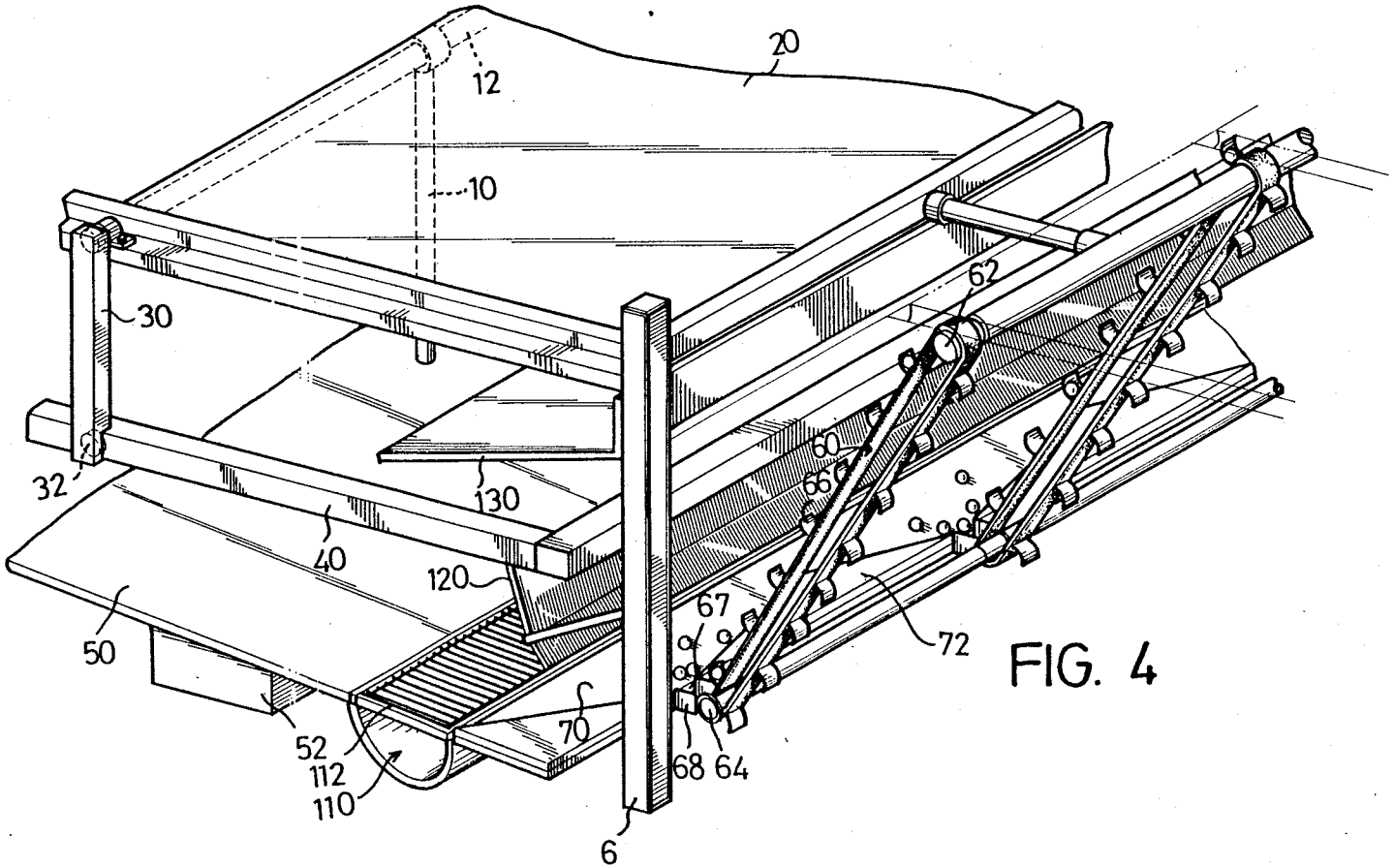
FIG. 4 is a cutaway perspective view of the practicing course showing the conveyers for conveying the golf balls.

Referring to FIGS. 1, 3 and 4, the automatic practicing course according to the present invention further comprises a plurality of rows of subposts 10 uniformly disposed within the area under the fairways. The subposts 10 are fixed on a ground level and upstanding therefrom to a level slightly lower than the fairways. Each row of the subposts 10 is connected by a turning bar 12 at their upper end, the turning bar 12 extends an overall width of the fairways.

The flat plates 20 are covered with rubber and artificial grass to form the fairways. Each plate 20 is pivotably mounted on a respective turning bar 12 and supported by the subposts 10. Each plate 20 has a width the same as the distance between two adjacent subposts 10. The plates 20 cover the overall fairway area.

A plurality of pairs of controlling bars 30 are engaged to both ends of the turning bars 12 at their upper ends. A pair of tappets 40 are horizontally disposed at both sides of the fairway and attached to a lower end of each controlling bar 30 and engaged thereat. The controlling bars 30 are substantially rectangular and engaged with the tappets 40 by any known means, for example, a screw-type bearing 32.

Referring to FIGS. 1–5, the present invention further comprises an inclined plate 50 provided below the tappets 40 and inclined toward a tee off area. The inclined plate 50 extends the overall length of the fairways. The inclined plate 50 is supported by distantly disposed bases 52 with its top surface having a same slope as the inclined plate 50.

Figure 7:
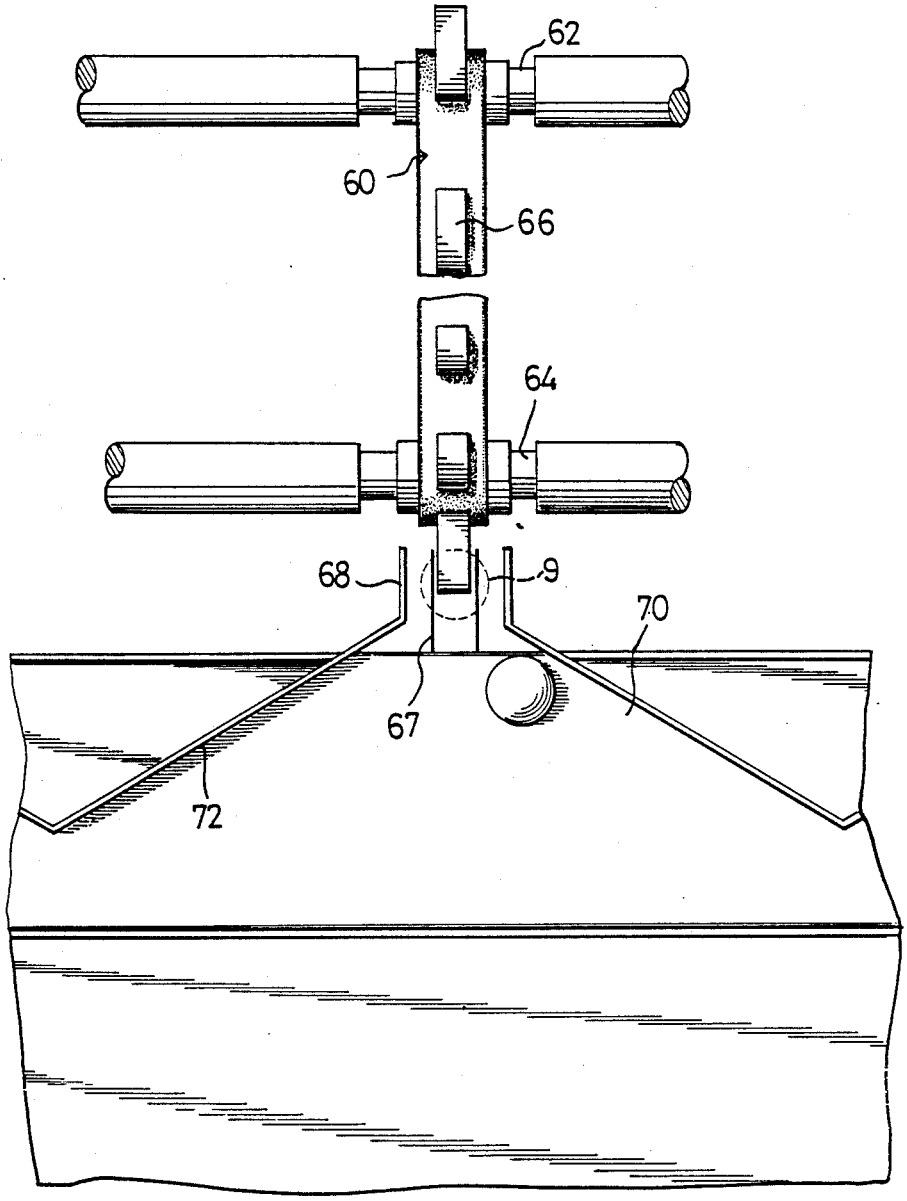
FIG. 7 is a front perspective view of a conveyor, in which a golf ball is guided and conveyed thereby.
Figure 8:
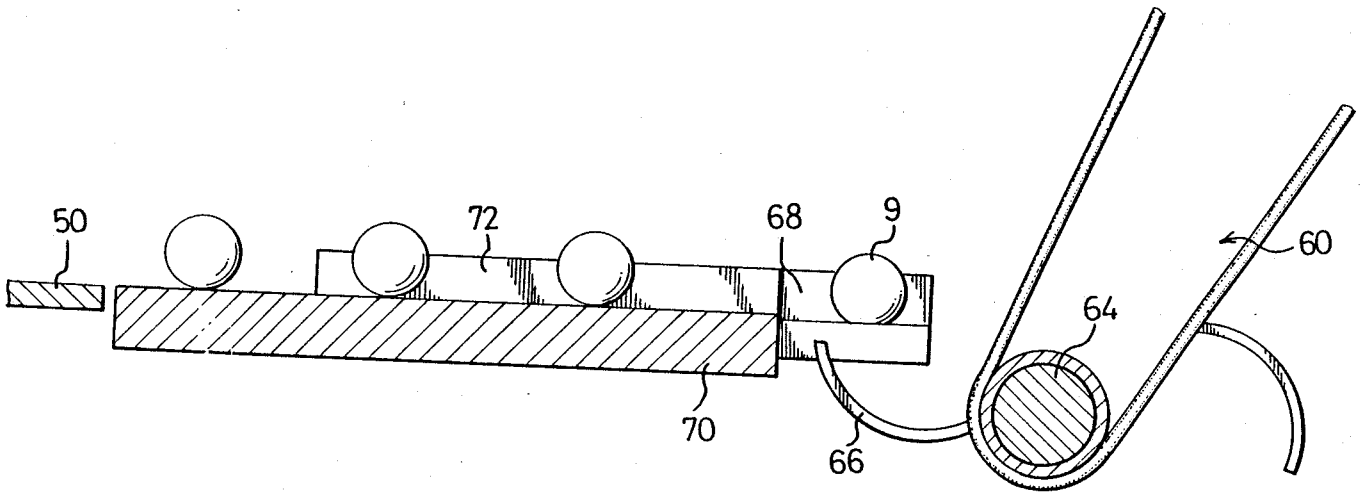
FIG. 8 is a side cross-sectional view showing a speed decelerating plate and the conveyer.

Referring to FIGS. 4, 5, 7 and 8, the present invention further comprises a plurality of conveyers 60 provided adjacent to a lower end of the inclined plate 50 for conveying the golf balls. The conveyers have a common upper shaft 62 and a common lower shaft 64. The conveyers are driven by either of the common shafts (62 or 64) connected to a power output unit (such as a motor). The conveyers 60 are preferably bucket conveyers with a plurality of buckets 66 provided thereon for receiving golf balls. A golf ball 9 is guided to an inlet 67 of the conveyer 60 by two side plates 68 and conveyed thereat as shown in FIGS. 7 and 8.

A leading plate 70 is provided between the inclined plate 50 and the conveyers 60. The leading plate 70 extends the overall width of the fairways. A plurality of triangle leading walls 72 (see FIGS. 4 and 7) are provided between the inputs of two adjacent conveyers 60 for leading the golf balls 9 to enter each input of each said conveyer.

The present invention further comprises a plurality of lifters 80 provided downstream of the conveyers 60 for lifting golf galls to rest on respective tees.

Figure 5:
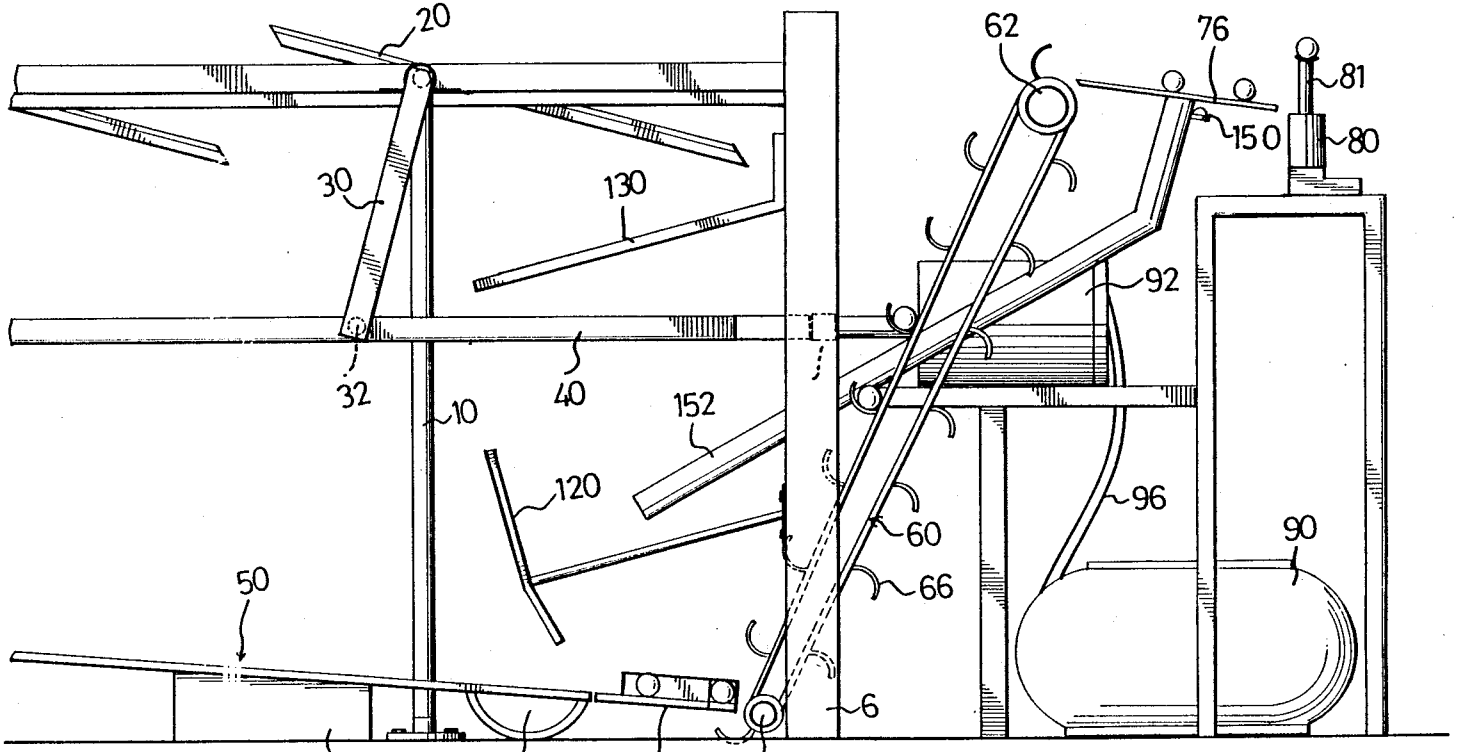
FIG. 5 is a cutaway side view of the practicing course, wherein an air compressor and a cylinder with a piston therein are illustrated.
Figure 6:
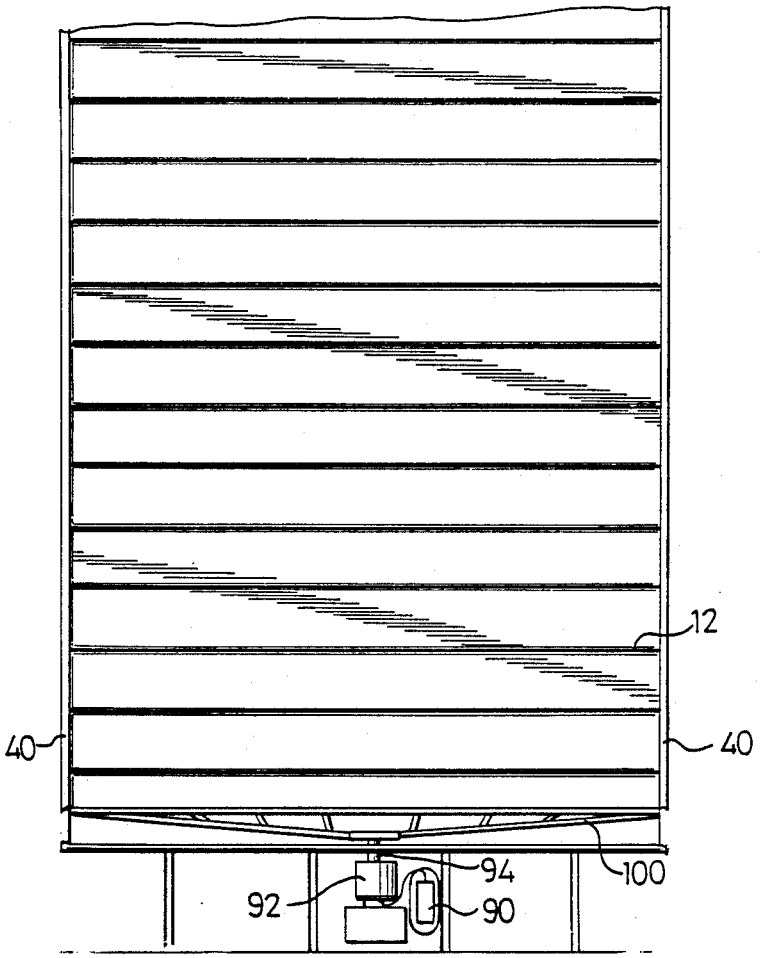
FIG. 6 is a top view of the practicing course with the flat plates removed and a pushing means clearly shown.

The present invention further comprises an air compressor 90 and cylinder 92 disposed behind a middle portion of pushing means with a piston 94 therein (as shown in FIG. 5). The piston is urged to move horizontally via pressurized air in air pipes 96 provided between the compressor 90 and the cylinder 92. The pushing means 100 is provided horizontally between the piston 94 and the tappets 40, the pushing means is actuated by the piston 94.

The piston 94 is urged by the compressor 90 and urges the pushing means 100 to push the tappets 40 in a first direction and turning the controlling bars 30 (see the solid lines in FIG. 3). The plates 20 are rotated to an inclined attitude which faces the golf practicers and allowing the golf balls to fall down on the inclined plate 50.

When the piston 94 is urged to move in a second, opposite direction (see the phantom lines in FIG. 3), the tappets 40 and the controlling bars 30 move back to their original positions due to gravity and the plates 20 are actuated to move upwardly to cover the overall area of the fairways and to allow golfing practice to continue.

Then, the golf balls are guided to the conveyers 60 and conveyed upwardly and then pass a passage 76 provided between an upper end of the conveyers 60 and the lifters 80, the balls then being elevated by each respective lifter 80 to appear on each respective tee to be used by various golf players.

Figure 9:
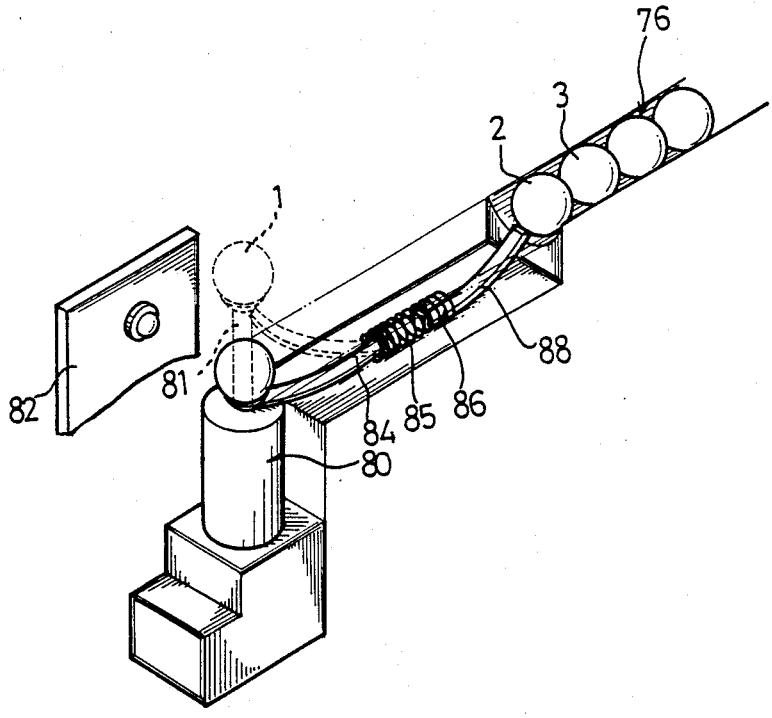
FIG. 9 is a schematic view showing a lifter and an electric eye provided for automatically supplying golf balls.

An electric eye 82 is provided with each lifter 80 adjacent to each respective tee, when a signal received indicating the golf ball has been teed off, the lifter 80 lifts another ball to rest on the tee and repeats such movement. Referring to FIG. 9, within the passage 76, a golf ball 1 has been lifted to rest on a tee. When the ball 1 has been hit by a practicer, a first strip 84 and a first spring 85 are effected by the impact of the hit to move upwardly and linkin-up a second plate 88 and a second spring 86 to move downwardly to allow another ball 2 to fall down to the seat provided above the piston 81 via a flat runway (not shown) therebetween. Then, the piston 81 begins to move downwardly to compress the first strip 84 and the first spring 85 to linkin-up the second spring 86 and the second strip 88 so as to prevent another ball 3 falling down right after the ball 2. When the ball 2 is put on the seat, the piston 81 lifts the ball 2 upwardly to appear on the tee, at the same time, the first strip 84 and the first spring 85 are moved upwardly but the second spring 86 and the second strip 88 are not linkin-up to allow the ball 3 from to fall down. The first and second spring 85 and 86 and the first and the second strip 84 and 88 are arranged to move in a longitudinal direction of the passage 76.

The automatic golf practicing course further comprises a drainage plate 110 provided between the inclined plate 50 and the leading plate 70 for draining water, rain or the like (as shown in FIG. 4). The drainage plate 110 extends the overall width of the practicing course. The drainage plate 110 comprises a plurality of bars 112 placed along the moving direction of golf balls. Each two adjacent bars have a distance therebetween which is smaller than a diameter of a golf ball.

For decelerating the speed of the balls to assure the balls being conveyed by the conveyers, a speed decelerating plate 120 is attached to two main posts 6 adjacent to the tee off area at an end and extends substantially the teeing direction in a manner that a lower end of the decelerating plate 120 is located adjacent to an end of the leading plate 70 near the drainage plate 110. The decelerating plate 120 extends the overall width of the practicing course and is disposed at a height slightly larger than a diameter of a golf ball for allowing a golf ball to pass through.

A front guiding plate 130 attached to the two main posts 6 adjacent to the tee off area is provided in front of a first plate adjacent to the golf player for guiding the golf balls falling in front of the triangle leading plate 72.

Furthermore, a hydraulic cylinder 140 (supported by any convenient means) with a supporting piston 142 therein is provided below a last plate 28 (with respect to the first plate adjacent to the players), the supporting piston 142 being attached to a lower side of the last plate 28. The hydraulic cylinder 140 may be communicated to the air compressor 90 so as to control the last plate 28 to perform as other plates synchronously.

A sensor 150 is provided within each passage 76 at a middle portion thereof. When the golf balls are loaded therein, a gate 152 provided on an internal lower surface of the passage 76 is opened after receiving a signal from the sensor 150 so as to let balls fall down in front of the leading plates 70 through a pipe 154.

In the automatic golf practicing course, the lifters 80 are preferably hydraulic lifting jacks.

As generally known, two sides of the practicing course may be covered with nets to prevent the golf balls from falling out of the course.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. An automatic golf practicing course having a plurality of fairways, comprising:

(a) four main posts 6, disposed on four corners of the course, four connecting bars 8 being provided therebetween for connecting each two adjacent main posts 6 at upper ends thereof to form a rectangular area of the fairways;

(b) a plurality of rows of subposts 10, being uniformly disposed within said area, said subposts 10 being fixed on a ground level and upstanding therefrom to a level slightly lower than the fairways; each row of subposts 10 being connected by a turning bar 12 provided thereon; said turning bar 12 extending an overall width of the fairways;

(c) a plurality of flat plates 20 being covered with rubber and artificial grass to form the fairways, said plates 20 being pivotably mounted on respective turning bars 12 and supported by said subposts 10; each said plate 20 having a width as the distance between two adjacent subposts 10; each said plate having a length extending an overall width of the fairways; said plates 20 covering an overall area of the fairways;

(d) a plurality of pairs of controlling bars 30, being engaged to both ends of said turning bars 12 at their upper ends;

(e) a pair of tappets 40, being horizontally disposed at both sides of the fairways beneath said connecting bars 8, said tappets 40 being attached to a lower end of each said controlling bar 30 and engaged thereat;

(f) an inclined plate 50, being provided below said tappets 40 and inclined toward a tee off area; said inclined plate 50 extending an overall area of the fairways; said inclined plate 50 being supported by distantly disposed base 52 with a top surface having a same slope as said plate;

(g) a plurality of conveyers 60, being provided adjacent to a lower end of said inclined plate 50 for conveying golf balls; said conveyers having a common upper shaft 62 and a common lower shaft 64; said conveyers being driven by one of said common shafts (62 or 64), said common shaft (62 or 64) being connected to a power output unit;

(h) a leading plate 70, being provided between said inclined plate 50 and said conveyers 60, said leading plate 70 extending an overall width of the fairways.

(i) a plurality of lifters 80, being provided proximate to said conveyers 60 for lifting golf balls to rest on respective tees;

(j) an air compressor 90 and a centrally disposed cylinder 92 having a piston 94 therein; said piston being urged to move horizontally via pressurized air in air pipes 96 provided between said compressor and said cylinder;

(k) a pushing means 100, being provided horizontally between said piston 94 and said tappets 40, said pushing means being actuated by said piston;

(l) whereby, (i) when said piston 94 is actuated by said compressor 90 to urge said pushing means 100 to push said tappets 40 in a first direction and to turn said controlling bars 30, said flat plates 20 being pivoted to an inclined attitude by pivoting said turning bars to face golf players and permitting the golf balls to fall down on said inclined plate 50;

(ii) when said piston 94 being actuated to move in a second direction, said tappets 40 and said controlling bars 30 moving back to their original positions by gravity and urging said flat plates 20 to move upwardly so as to cover the overall area of the fairways and allowing the practicing to continue;

(iii) the golf balls being guided to said conveyers 60 and conveyed therefrom and passing a passage 76 provided between an upper end of said conveyers 60 and said lifters 80, the golf balls then being elevated by respective lifters 80 to appear on respective tees to be used by various golf players;

(iv) an electric eye 82 which is connected with each said lifter 80 is provided adjacent to each respective tee, the lifter 80 lifting another ball to rest on the tee and repeating such movement when receiving a stricken out message of a ball on a tee.

2. An automatic golf practicing course as set forth in claim 1, further comprising a drainage plate 110 provided between said inclined plate 50 and said leading plate 70 for draining water, said drainage plate 110 extending an overall width of the practicing course, said drainage plate 110 being comprised of a plurality of bars 112 placed along the moving direction of golf balls and having a distance from each other smaller than a diameter of a golf ball.

3. An automatic golf practicing course as set forth in claim 1, further comprising a speed decelerating plate 120 provided between said drainage plate 110 and said leading plate 70 for decelerating the speed of the golf balls, said decelerating plate 120 being attached to two said main posts adjacent to the tee off area at an end and extending substantially in the teeing direction; a lower end of the decelerating plate 120 is located adjacent to an end of the leading plate 70 near the drainage plate 110; said decelerating plate extending an overall width of the practicing course, said decelerating plate 120 being disposed at a height slightly larger than a diameter of a golf ball.

4. An automatic golf practicing course as set forth in claim 1, wherein said leading plate comprises a plurality of triangle leading walls 72 thereon between each input of two adjacent conveyers 60 for leading the golf balls entering each input of each said conveyer.

5. An automatic golf practicing course as set forth in claim 1, further comprising a front guiding plate 130 provided in front of a first plate adjacent to the golf player for guiding the golf balls falling in front of said triangle leading plate 72.

6. An automatic golf practicing course as set forth in claim 1, wherein a hydraulic cylinder 140 with a supporting piston 142 therein is provided below a last plate 28 with respect to said first plate adjacent to the players, said supporting piston 142 being attached to a lower side of the last plate 28 for controlling the last plate 28 so as to move with other said flat plates synchronously.

7. An automatic golf practicing course as set forth in claim 1, further comprising a sensor 150 provided within each passage 76 between said upper end of each said conveyers 60 and each said lifter 80, said sensor 150 opening a gate 152 provided on an internal lower surface of said passage 76 and letting balls fall down in front of said leading plates 70 through a pipe 154 when golf balls are not lifted to the tees and loaded thereon.

8. An automatic golf practicing course as set forth in claim 1, wherein said conveyers 60 are bucket conveyers.

9. An automatic golf practicing course as set forth in claim 1, wherein said controlling bars 30 are rectangular and engage with said tappets 40 by means of screw-type bearings.

10. An automatic golf practicing course as set forth in claim 1, wherein said lifters 80 are hydraulic lifting jacks.

* * * * * .